US005478263A

United States Patent [19]

Kato

[11] Patent Number: 5,478,263

[45] Date of Patent: Dec. 26, 1995

[54] TERMINAL FOR CONNECTOR WITH ENGAGING MECHANISM

[75] Inventor: Tetsuo Kato, Shizuoka, Japan

[73] Assignee: Yazaki Corporation, Tokyo, Japan

[21] Appl. No.: 270,217

[22] Filed: Jul. 1, 1994

Related U.S. Application Data

[63] Continuation of Ser. No. 63,691, May 20, 1993, abandoned.

[30] Foreign Application Priority Data

Jun. 3, 1992 [JP] Japan ..... 4-142604

[51] Int. Cl.[6] ..... H01R 13/436

[52] U.S. Cl. ..... 439/752

[58] Field of Search ..... 439/752, 595

[56] References Cited

U.S. PATENT DOCUMENTS 4,867,712 9/1989 Kato et al. ..... 439/752

FOREIGN PATENT DOCUMENTS 54-15173 6/1979 Japan .

58-71986 5/1983 Japan .

64-54678 3/1989 Japan .

*Primary Examiner*—Gary F. Paumen

*Attorney, Agent, or Firm*—Sughrue, Mion, Zinn, Macpeak & Seas

[57] ABSTRACT

Disclosure is to provide a terminal for a connector including an engagement mechanism which assures that the terminal can reliably be held in an electrical insulative housing in the engaged state while generating excellent terminal holding force and exhibiting high reliability. The terminal is made of a sheet of metallic material having electrical conductivity and includes an cable connecting portion, a rectangular column-shaped electrical contact portion, engagement pieces formed by cutting and bending a part of one wall of the electrical contact portion in the upward direction, and shock absorbing portions formed by inwardly folding rear edge portions of the engagement pieces. Engagement projections projecting from an insert pin of the connector including an engagement mechanism are brought into contact with the engagement pieces of the terminal with an increased contact area.

2 Claims, 4 Drawing Sheets

TERMINAL FOR CONNECTOR WITH ENGAGING MECHANISM

This is a continuation of application Ser. No. 08/063,691 filed May 20, 1993, now abandoned.

BACKGROUND OF THE INVENTION

1. Field of the Invention

The present invention relates to a terminal for a connector with an engagement mechanism.

2. Prior art

To firmly hold a terminal in a connector, the following process has been hitherto generally employed. Specifically, an engagement piece formed by cutting and bending a part of the terminal in the upward direction is engaged with the bottom wall of a terminal receiving chamber in an electrical insulative housing of the connector. Otherwise, an engaging arm formed integral with a ceiling wall of the terminal receiving chamber is engaged with a shoulder portion or a hole formed on an electrical connecting portion of the terminal.

However, each of the engagement piece and the engagement arm is designed with small dimensions, and as a female connector is repeatedly connected to and disconnected from a male connector, they are readily damaged or broken. In addition, there arises a malfunction that the terminal is disconnected from the opponent housing or incorrect contact occurs therebetween.

In the circumstances as mentioned above, a proposal has been made with respect to a connector as shown in FIG. 7 and FIG. 8 wherein the connector designated by reference character K is constructed such that through holes 3 are formed through an electrical insulative housing 2 and an insert pin 4 is fitted into the through holes 3 so that engagement projections 5 formed on side wall surfaces of the insert pin 4 are brought into contact with engagement portions 6 projecting from an electrical contact portion la of a terminal 1 to establish double engagement therebetween in addition to the disconnection preventing means as mentioned above (cf. Japanese Unexamined Patent Publication NO. 64-54678).

The insert pin 4 to be inserted into the connector K is molded of an electrically insulative synthetic resin in the same manner as the electrical insulative housing 2, while the terminal 1 is made of a sheet of metallic material having electrical conductivity and the engagement portions 6 are formed by cutting and bending a part of the sheet of metallic material for the terminal 1 in the upward direction. With this construction, any trouble does not arise as long as the terminal 1 is exactly inserted into the housing 2 at a predetermined position when the insert pin 4 is fitted into the through holes 3 for bringing the engagement portions 6 of the terminal 1 in engagement with the engagement projections 5 of the insert pin 4. However, in case that the terminal 1 is incompletely inserted into the housing 2 of the connector K, there arise problems as illustrated in FIG. 9 and FIG. 10.

Specifically, in case that the position where the terminal 1 is inserted into the housing of the connector K is largely dislocated away from a predetermined position as shown in FIG. 9, the engagement projections 5 of the insert pin 4 come in contact with the uppermost ends **6*a* of the engagement portions 6, resulting in the insert pin 4** failing to be inserted to reach a predetermined position. This means that the incomplete insertion of the terminal into the housing of the connector K can visually be recognized with operators's eyes.

On the other hand, in case that the position where the terminal 1 is inserted into the housing of the connector K is slightly dislocated away from the predetermined position as shown in FIG. 10, the engagement projections 5 of the insert pin 4 come in contact with shoulder portions **6*b* of the engagement portions 6 of the terminal 1. Since the shoulder portions 6*b* of the engagement portions 6 are formed with sharp edges by cutting and bending a sheet of metallic material having a small thickness in the upward direction, there arises an occasion that the insert pin 4 is inserted to the predetermined position because a part of each of the engagement projections 5 of the insert pin 4 is cut off with the foregoing sharp edges of the shoulder portions 6*b* when the insert pin 4 is thrusted with an operator's hand as shown in FIG. 11. This means that the incomplete insertion of the terminal 1** into housing of the connector K can not visually recognized with operator's eyes. In this case, there arises a problem that terminals are incompletely connected to each other, causing incorrect electrical conduction to occur with the connector K.

SUMMARY OF THE INVENTION

In view of the forgoing problems, an object of the present invention is to provide a terminal for a connector including an engagement mechanism which assures that the terminal can reliably be held in the engaged state in an electrical insulative housing without significant damage or brankage on an insert pin while generating excellent terminal holding force and exhibiting high reliability wherein shock absorbing portions adapted to be brought in contact with engagement projections projecting from an insert pin are formed on engagement pieces of the terminal.

To accomplish the above object, the present invention provides a terminal for a connector wherein through holes are formed through an electrical insulative housing of the connector so as to allow engagement projections projecting from an insert pin to be engaged with engagement pieces formed on the terminal in order to prevent the terminal from being disengaged from housing of the connector, wherein the terminal is made of a sheet of metallic material having electrical conductivity and includes a cable connecting portion, a rectangular column-shaped electrical contact portion, and engagement pieces adapted to be engaged with the engagement pieces of the insert hole, the engagement pieces being formed by cutting and bending a part of one wall of the electrical contact portion in the upward direction and that shock absorbing portions are formed on the engagement pieces to serve as shock absorbing portion for the insert pin. It is preferable to form the shock absorbing portion by folding the rear end portion of the engagement piece.

According to the present invention, since the terminal includes shock absorbing portions formed by folding the rear edge portions of the engagement pieces, a load to be borne by the terminal when the engagement projections come in contact with the engagement pieces can substantially be attenuated while preventing the engagement projections of the insert pin from being damaged or broken. In addition, any incomplete insertion of the terminal into the housing of the connector can easily be detected.

In case that the engagement pieces include shock absorbing portions smoothly extending from the rear edge portions in the form of curved lines, a load to be borne by the terminal via the engagement pieces when the engagement projections of the insert pin come in contact with the shock absorbing portions of the engagement portions can substantially be alleviated. In addition, since the terminal can forwardly be displaced to some extent by the thrusting fore given by the insert pin when the latter is inserted into the housing, the position where the terminal is incompletely inserted into the housing can be corrected to a predetermined position.

DETAILED DESCRIPTION OF THE PREFERRED EMBODIMENTS

The present invention will now be described in detail hereinafter with reference to the accompanying drawings.

Figure 1:
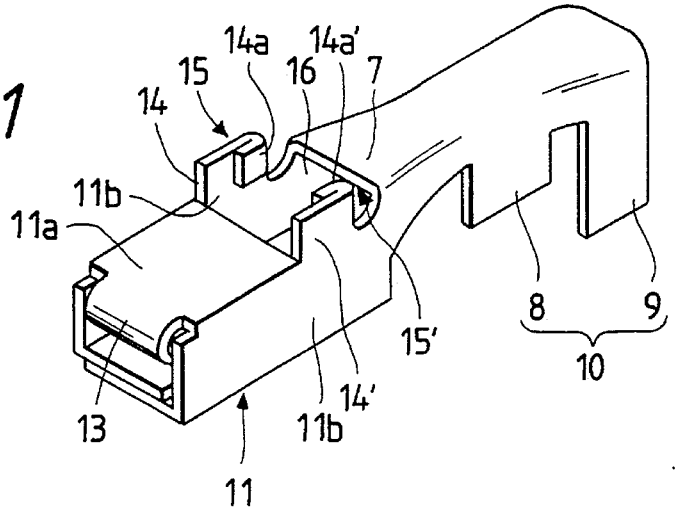
FIG. 1 is a perspective view of a terminal for a connector of one embodiment of the present invention.

Among the drawings, FIG. 1 is a perspective view which illustrates a terminal A for one connector constructed according to an embodiment of the present invention.

The terminal A is produced by press-working a sheet of metallic material having electrical conductivity wherein the sheet of metallic material is used as a base plate 7. A cable connecting portion 10 having a conductor crimping piece 8 and a cable crimping piece 9 formed on the base plate 7 are projected from one end of the base plate 7 for the terminal A, while a rectangular column-shaped electrical contact portion 11 is formed at the other end of the base plate 7.

The electrical contact portion 11 includes an arc-shaped elastic contact piece 13 which is formed by cutting and bending the fore end part of one wall 11*a* of the electrical contact portion 11 in the downward direction. In addition, the electrical contact portion 11 includes a pair of engagement pieces 14 and 14' which are formed by cutting and bending a part of the one wall 11*a* in the upward direction while extending in parallel with both side walls 11*b* of the electrical contact portion 11. The engagement pieces 14 and 14' include shock absorbing portions 15 and 15' which are formed by bending and folding rear side edge parts 14*a* and 14*a'* of the engagement pieces 14 and 14' located on the cable connecting portion 10 side in the inward direction.

While the engagement pieces 14 and 14' are formed in that way, an opening portion 16 formed on the wall 11*a* of the electrical contact portion 11 is used as an engagement hole adapted to be engaged with an engagement member (not shown) formed in an electrical insulative housing.

Figure 2:
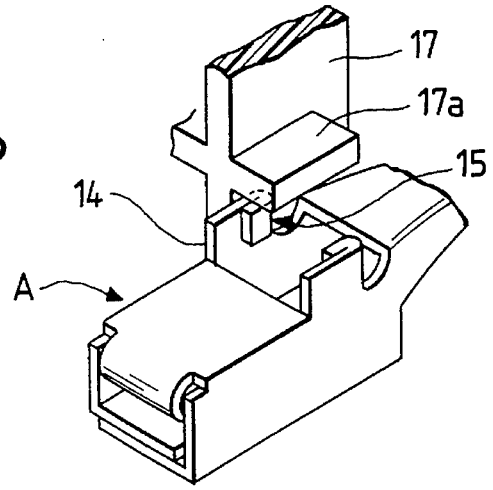
FIG. 2 is a fragmentary perspective view of the terminal shown in FIG. 1, particularly illustrating how a shock absorbing portion.

As shown in FIG. 2, when the terminal A is inserted into the electrical insulative housing of the connector, the shock absorbing portions 15 and 15' are brought into contact with engagement projections 17*a* projecting from an insert pin 17. Since a contact area of each of the shock absorbing portions 15 and 15' is enlarged about twice compared with the engagement piece of the conventional terminal as mentioned above, a load to be borne by each of the shock absorbing portions 15 and 15' per unit area against the thrusting force given by the insert pin 17 when the latter is inserted into the housing 2 is substantially alleviated, resulting in an occurrence of damage or breakage of the engagement portions 17*a* being minimized.

Figure 3:
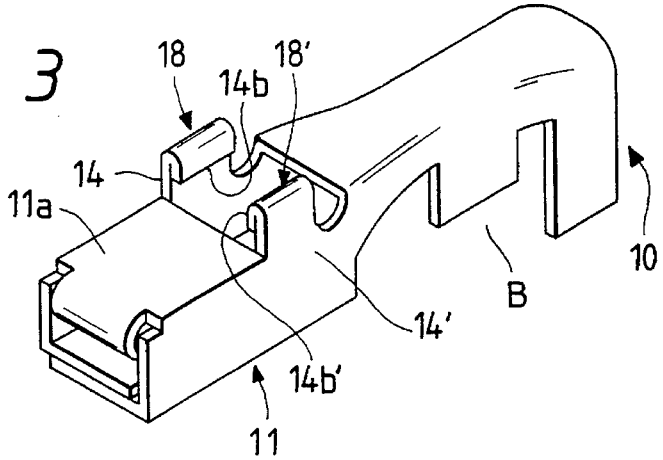
FIG. 3 is a perspective view of a terminal for a connector constructed according to another embodiment of the present invention.

FIG. 3 is a perspective view of a terminal B for a connector constructed according to other embodiment of the present invention wherein shock absorbing portions of engagement pieces are designed in the different manner from the terminal A.

In this embodiment, shock absorbing portions 18 and 18' are formed by folding free end parts 14*b* and 14*b'* of engagement pieces 14 and 14' in the inward direction in contrast with the terminal A of which shock absorbing portions 15 and 15' are formed by folding the rear edge parts 14*a* and 14*a'* of the engagement pieces 14 and 14' in the inward direction. The terminal B is constructed in the same manner as the terminal A with the exception that the shock absorbing portions 18 and 18' are designed in the different manner from the shock absorbing portions 15 and 15' of the terminal A. Thus, repeated description on other components rather than the shock absorbing portions 18 and 18' will not be required.

Since the shock absorbing portions 18 and 18' of the terminal B are formed by folding the free end parts 14*b* and 14*b'* of the engagement pieces 14 and 14' in the inward direction, the engagement pieces 14 and 14' of the terminal B are brought into contact with the engagement projections 17*a* of the insert pin 17 at the positions located outside of the curved shock absorbing portions 18 and 18' folded in the inward direction. Thus, in contrast with the conventional terminal of which engagement pieces are formed with sharp edges by cutting and bending a sheet of metallic material in the upward direction, there does not arise a malfunction that the engagement projections 17*a* of the insert terminal 17 are damaged or broken by the sharp edges as mentioned above with reference to the conventional terminal.

Figure 4:
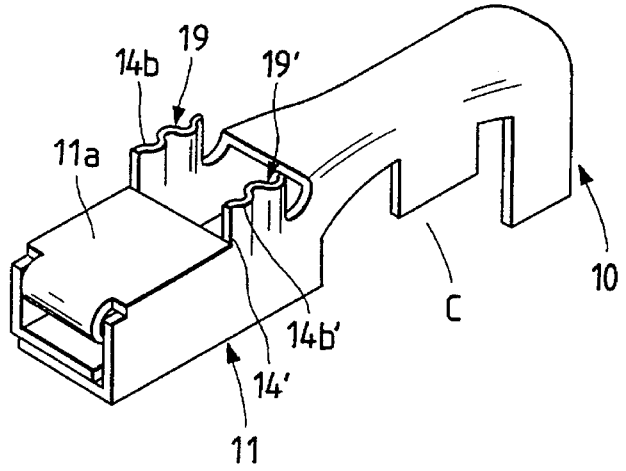
FIG. 4 is a perspective view of a terminal for a connector constructed according to another embodiment of the present invention.

FIG. 4 is a perspective view of a terminal C for a connector constructed according to another embodiment of the present invention wherein shock absorbing portions of engagement pieces are designed in the different manner from the terminal A and the terminal B.

In this embodiment, the terminal C includes shock absorbing portions 19 and 19' which are formed by press-working free end parts 14*b* and 14*b'* of engagement pieces 14 and 14' in the corrugated contour. Since other components of the terminal C are designed in the same manner as the preceding embodiments, repeated description on these components will not be required.

Since the terminal C includes corrugated shock absorbing portions 19 and 19', engagement pieces 14 and 14*a* of the terminal C are brought into contact with the engagement projections 17*a* of the insert pin 17 with an increased area of each contact portion. Thus, there does not arise a malfunction that the engagement projections 17*a* of the insert pin 17 are damaged or broken by the shock absorbing portions 19 and 19'.

Next, description will be made below with respect to a terminal D for a connector constructed according to further embodiment of the present invention.

Figure 5:
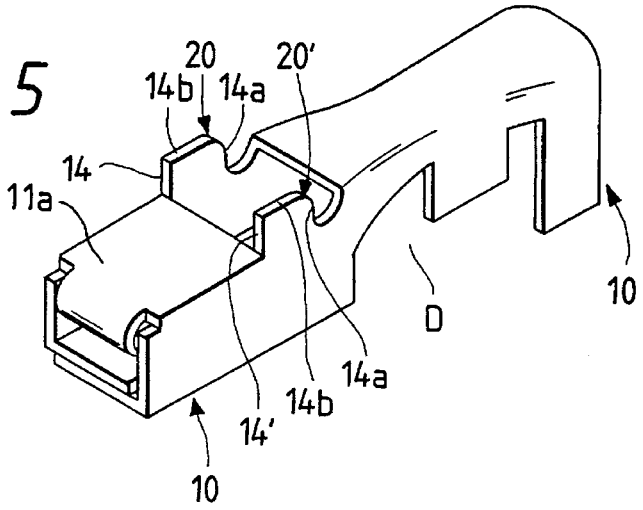
FIG. 5 is a perspective of a terminal for a connector constructed according to another embodiment of the present invention.
Figure 6:
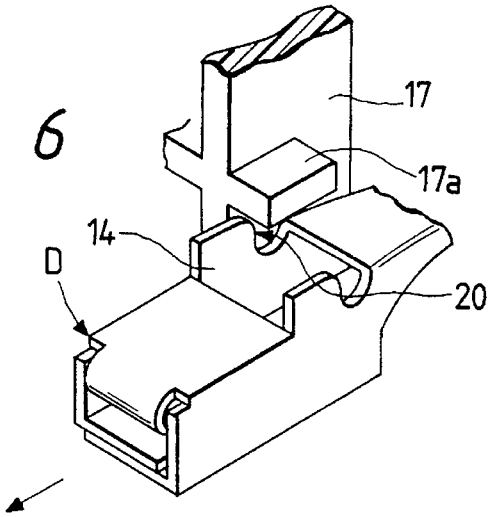
FIG. 6 is a fragmentary perspective view of the terminal shown in FIG. 5, particularly illustrating how a shock absorbing portion.
Figure 7:
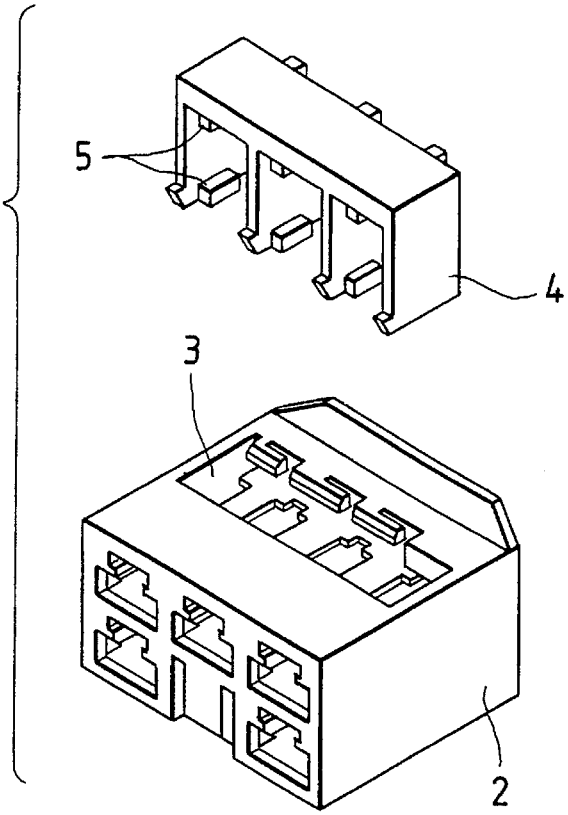
FIG. 7 is a perspective view of an electrical insulative housing of a conventional connector including a double engagement mechanism.
Figure 8:
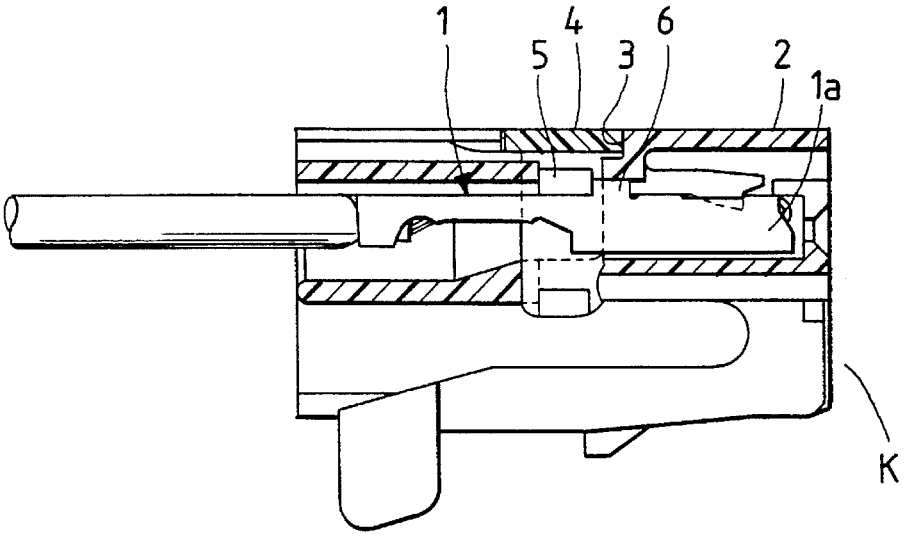
FIG. 8 is sectional view of the connector shown in FIG. 7, particularly showing that a terminal is inserted into the housing.
Figure 9:
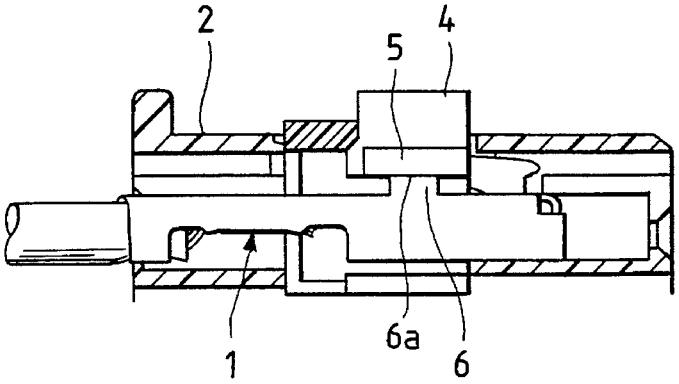
FIG. 9 PRIOR ART
FIG. 9 is a sectional view of the connector shown in FIG. 7, particularly illustrating that the terminal is incompletely inserted into the housing.
Figure 10:
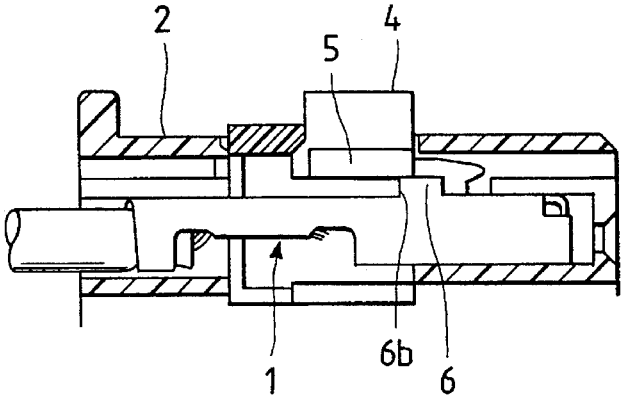
FIG. 10 PRIOR ART
FIG. 10 is sectional view of the connector shown in FIG. 7, particularly illustrating that the terminal is insufficiently inserted into the housing.
Figure 11:
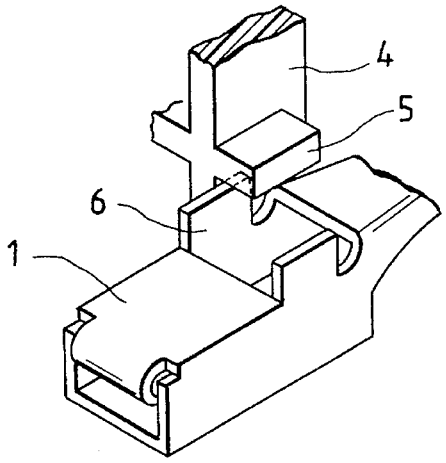
FIG. 11 PRIOR ART
FIG. 11 is a fragmentary perspective view of the connector shown in FIG. 7, particularly illustrating how an engagement portion of the terminal is brought into contact with an engagement projection projecting from the insert pin when the latter is inserted into the housing.

FIG. 5 is a perspective view of the terminal D.

Since the terminal D is formed in the same manner as the terminal A with the exception of shock absorbing portions 20 and 20', description will be made only with respect to the shock absorbing portions 20 and 20'.

In detail, the terminal D includes shock absorbing portions 20 and 20' which are designed with smoothly curved lines extending from rear edge parts 14*a* and 14*a* to free end parts 14*b* and 14*b'* of engagement pieces 14 and 14' in contrast with the terminal A wherein the rear edges parts 14*a* and 14*a'* are folded in the inward direction.

When the terminal D is incompletely inserted into the electrical insulative housing of the connector, the smoothly curved shock absorbing portions 20 and 20' of the terminal D are brought into contact with the engagement projections 17*a* of the insert pin 17, whereby the terminal D is displaced in the arrow-marked direction by the thrusting force given by the insert pin 17 when the latter is inserted into the housing. Thus, in case that the terminal D is incompletely inserted into the housing of the connector, the position where the terminal D is incompletely inserted into the housing of the connector can be corrected to a predetermined position located in the housing of the connector by the thrusting force given by the insert pin 17 when the latter is inserted into the housing.

In each of the aforementioned embodiments, the engagement pieces 14 and 14' of the connector are formed by cutting and folding a part of the wall 11*a* of the electrical contact portion 11 in the inward direction. Alternatively, the present invention can equally be applied to a terminal for a connector wherein engagement pieces are formed by cutting and folding a part of the lower wall of the terminal located opposite to the wall 11*a* of the electrical contact portion 11 in the inward direction so that the engagement pieces of the terminal is brought into contact with engagement projections of the insert pin inserted into the housing of the connector from below.

Since the terminal for a connector constructed according to the present invention includes shock absorbing portions which are formed by cutting and folding the rear edge parts of the engagement pieces, there does not arise a malfunction that the engagement projections of the insert pin adapted to be engaged with the engagement portions of the terminal are damaged or broken with sharp edges when the terminal including an engagement mechanism is inserted into the electrical insulative housing of the connector. In addition, any incomplete insertion of the terminal into the housing can easily be detected by an operator. Consequently, reliability of the terminal to be inserted into the housing of the connector can be improved while preventing a malfunction such as incorrect electrical conduction or the like from occurring due to incomplete insertion of the terminal into the housing of the connector. In case that the shock absorbing portion are designed in the form of curved lines smoothly extending from the rear edge parts of the engagement pieces, a load to be borne by the terminal via the engagement pieces when the terminal is inserted into the housing can substantially be alleviated. In addition, the position where the terminal is incompletely inserted into the housing can be corrected to a predetermined position by the thrusting force given by the insert pin when the latter is inserted into the housing. Thus, each connector assembling operation can be achieved at an improved operational efficiency.

What is claimed is:

1. A terminal insertable into a chamber of a connector housing in a forward, longitudinal direction and adapted to be retained therein by an insertion pin which is insertable into said housing in a transverse direction which is transverse to said longitudinal direction, said terminal comprising:

a cable connecting member for connecting a cable, said cable connecting member being formed at one end portion of said terminal;

an electrical contact member disposed on the other end portion of said terminal, said contact member including a pair of opposing side walls between which a mating terminal is receivable; and an engagement piece extending in said transverse direction from at least one of side side walls, said engagement piece being bent about an axis which is substantially parallel to said transverse direction so as to maximize an area of a top surface thereof, wherein when said terminal is in a completely inserted position in said housing, said insertion pin can be inserted into said housing in said transverse direction to a predetermined position at which an engagement projection thereof abuts against a rear surface of said engagement piece to prevent said terminal from being moved in a rearward direction, and wherein when said terminal is in a partially inserted position, the engagement projection of the insertion pin abuts against the top surface of said engagement piece to thereby be prevented from being inserted to said predetermined position, whereby the possibility of damage to the engagement projection is minimized due to the maximized area of the top surface of said engagement piece.

2. A terminal as claimed in claim 1, wherein said engagement piece is corrugated in a wave-like manner.

* * * * *